United States Patent [19]

Yu et al.

[11] Patent Number: 4,786,570

[45] Date of Patent: Nov. 22, 1988

[54] LAYERED, FLEXIBLE ELECTROPHOTOGRAPHIC IMAGING MEMBER HAVING HOLE BLOCKING AND ADHESIVE LAYERS

[75] Inventors: Robert C. U. Yu, Webster; Anthony M. Horgan, Pittsford; Donald P. Sullivan, Rochester; John A. Bergfjord, Macedon, all of N.Y.

[73] Assignee: Xerox Corporation, Stamford, Conn.

[21] Appl. No.: 41,019

[22] Filed: Apr. 21, 1987

[51] Int. Cl.[4] ..... G03G 5/14

[52] U.S. Cl. ..... 430/58; 430/59; 430/64; 430/60

[58] Field of Search ..... 430/58, 59, 60, 64, 430/65

[56] References Cited

U.S. PATENT DOCUMENTS

| | | | |
|---|---|---|---|
| 4,150,987 | 4/1979 | Anderson et al. | 430/59 |
| 4,173,472 | 11/1979 | Berwick et al. | 430/60 |
| 4,291,110 | 9/1981 | Lee | 430/58 X |
| 4,378,418 | 3/1983 | Chu | 430/59 |
| 4,381,337 | 4/1983 | Chang | 430/58 |
| 4,464,450 | 8/1984 | Teuscher | 430/59 |
| 4,489,148 | 12/1984 | Horgan | 430/59 |
| 4,492,746 | 1/1985 | Miyakawa et al. | 430/71 |
| 4,565,760 | 1/1986 | Schank | 430/66 |
| 4,582,772 | 5/1986 | Teuscher et al. | 430/58 |
| 4,584,253 | 4/1986 | Lin et al. | 430/59 |
| 4,588,667 | 5/1986 | Jones | 430/73 |
| 4,592,961 | 6/1986 | Ehrreich | 428/480 |

*Primary Examiner*—J. David Welsh

[57] ABSTRACT

A flexible electrophotographic imaging member is disclosed which comprises a flexible substrate having an electrically conductive surface, a hole blocking layer comprising an aminosilane reaction product, an adhesive layer having a thickness between about 200 angstroms and about 900 angstroms consisting essentially of at least one copolyester resin having the following formula:

$$HOC(=O)-[\text{diacid-diol}]_n-OH$$

wherein the diacid is selected from the group consisting of terephthalic acid, isophthalic acid, and mixtures thereof, the diol comprises ethylene glycol, the mole ratio of diacid to diol is 1:1, n is a number between about 175 and about 350 and the $T_g$ of the copolyester resin is between about 50° C. to about 80° C., the aminosilane also being a reaction product of the amino group of the silane with the —COOH and —OH end groups of the copolyester resin, a charge generation layer comprising a film forming polymeric component, and a diamine hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer. Processes for fabricating and using the flexible electrophotographic imaging member are also disclosed.

20 Claims, 7 Drawing Sheets

LAYERED, FLEXIBLE ELECTROPHOTOGRAPHIC IMAGING MEMBER HAVING HOLE BLOCKING AND ADHESIVE LAYERS

BACKGROUND OF THE INVENTION

This invention relates in general to electrophotography and more specifically, to an electrophotographic imaging member and process for using the imaging member.

In the art of electrophotography an electrophotographic plate comprising a photoconductive insulating layer on a conductive layer a imaged by first uniformly electrostatically charging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

As more advanced, higher speed electrophotographic copiers, duplicators and printers were developed, degradation of image quality was encountered during extended cycling. Moreover, complex, highly sophisticated, duplicating and printing systems operating at very high speeds have placed stringent requirements including narrow operating limits on photoreceptors. For example, the numerous layers found in many modern photoconductive imaging members must be highly flexible, adhere well to to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, a blocking layer, an adhesive layer, a charge generating layer, and a charge transport layer. This photoreceptor may also comprise additional layers such as an anti-curl backing layer and an overcoating layer. Although excellent toner images may be obtained with multilayered belt photoreceptors, it has been found that the numerous layers limit the versatility of the multilayered belt photoreceptor. For example, there is a great need for long service life flexible photoreceptors in compact imaging machines that employ small diameter support rollers for photoreceptors belt systems fitted into a very confined space. Small diameter support rollers are also highly desirable for simple, reliable copy paper stripping systems which utilize the beam strength of the copy paper to automatically remove copy paper sheets from the surface of a photoreceptor belt after toner image transfer. Unfortunately, small diameter rollers, e.g less than about 0.75 inch (19 mm) diameter, raise the threshold of mechanical performance criteria to such a high level that spontaneous photoreceptor belt material failure becomes a frequent event for multilayered belt photoreceptors. Thus, in advanced imaging systems utilizing multilayered belt photoreceptors, cracking has has been encountered in one or more critical photoreceptor layers during belt cycling over small diameter rollers. Cracks developed in charge transport layers during cycling were manifested as print-out defects which adversely affected copy quality. Frequent photoreceptor cracking has a serious impact on the versatility of a photoreceptor and reduces the its practical value for automatic electrophotographic copiers, duplicators and printers.

Moreover, seams in multilayered belt photoreceptors tend to delaminate during extended cycling over small diameter support rollers. Seam delamination is further aggravated when the belt is employed in electrophotographic imaging system utilizing blade cleaning devices. In addition, belt delamination is encountered during web slitting operations to fabricate belt photoreceptors from wide webs. Alteration of materials in the various belt layers such as the conductive layer, blocking layer, adhesive layer, charge generating layer, and/or the charge transport layer to reduce delamination is not easily effected because the new materials may adversely affect the overall electrical, mechanical and other properties of the belt such as residual voltage, background, dark decay, flexibility and the like.

Moreover, the electrical cyclic stability of transport layers in multilayer structured photoreceptors has been found to be unstable when cycled thousands of times in liquid development systems. The carrier fluid of the liquid developer tends to leach out active small molecules, such as diamine compounds, present in the charge transport layers thereby altering the electrical characteristics of the photoreceptor. The leaching out of the active small molecule increases the susceptibility of the transport layer to solvent/stress cracking when the belt is parked over a belt support roller during periods of non-use. Some carrier fluids also promote crystallization of the active small molecules, such as diamine compounds, in the transport layers, particularly when high concentrations of the diamine compounds are present in the transport layer binder. Crystallization of active small molecules adversely alters the electrical and mechanical properties of a photoreceptor.

Photoreceptors having charge transport layers containing small molecule diamine compounds are well known in the art. Similarly, photoreceptors utilizing polyester adhesive layers are also known.

PRIOR ART STATEMENT

U.S. Pat. No. 4,584,253 to Lin et al, issued Apr. 22, 1986—Various electrophotographic imaging members are disclosed including a multilayered imaging member having, between a blocking layer (e.g. a film of siloxane and hydroxypropyl cellulose) and a charge generating layer, an adhesive layer which includes film-forming polymers such as polyester PE-100, du Pont 49,000 resin and other resins (e.g. see column 8, lines 31–41 and column 17, lines 8–18). This adhesive layer has a thickness between about 0.1 micron (1,000 angstroms and about 5 microns (50,000 angstroms).

U.S. Pat. No. 4,150,987 to Anderson et al, issued Apr. 24, 1979—Various electrophotographic imaging members are disclosed including, for example, a multilayered imaging member comprising an aluminized Mylar support, a polyester adhesive layer such as PE-200, PE-222, PE-207, VPE-5545 PE-307 and 49000) on the aluminum layer, a charge generating layer, and a hydrazone charge transport layer. The polyester adhesive layer is applied as a solution containing 10 percent by weight solids.

U.S. Pat. No. 4,381,337 to Chang, issued Apr. 26, 1983—Various electrophotographic imaging members are disclosed including a multilayered imaging member comprising an electroconductive layer, a charge generating layer, and a charge transport layer wherein a mixture of a polyester having a $T_g$ larger than about 60° C. with a polyester having a $T_g$ smaller than about 30° C. is employed in an adhesive layer on the electroconductive support and in the charge transporting layer. numerous specific polyester resins are listed in the paragraph bridging columns 2 and 3, including Vitel PE-200, Vitel PE-100, PE-307 and PE-5571A.

U.S. Pat. No. 4,173,472 to Berwick et al, issued Nov. 6, 1979—Various electrophotographic imaging members are disclosed including a multilayered imaging member having, between an electrically conducting layer and a photoconductive layer, a polyester interlayer (e.g see column 2, line 34 to column 3, line 2). The polyester can be derived from at least one aromatic dicarboxylic acid and at least one diol. At least one of the aromatic dicarboxylic acids can be an isophthalic acid and the diol can be a branched-chain alkylene diol. The polyester can be derived from mixture of two different acids or or two different diols A barrier layer can be employed between the conductive layer and the interlayer (e.g. see column 7, lines 20–41). The interlayer typically has a dry thickness of from about 0.1 to about 0.5 microns (1,000 to 5,000 angstroms). In Example 6, a copolyester of terephthalic acid, isophthalic acid and ethylene glycol is employed as an interlayer in a photoreceptor.

U.S. Pat. No. 4,588,667 to Jones, issued May 13, 1986—Various overcoated electrophotographic imaging members are disclosed including a multilayered imaging member having a substrate, a titanium metal layer, a siloxane blocking layer, an adhesive layer, a charge generating binder layer, and a charge transport layer. An intermediate layer between the blocking layer and a generator layer may contain a polyester and have a dry thickness of between about 0.1 micron (1,000 angstroms) and about 5 microns (50,000 angstroms). A polyester du Pont 49000 intermediate layer having a thickness of about 0.05 micrometer (500 angstroms) is described in the working examples. The transport layer may contain from about 25 to about 75 percent by weight of a diamine transport material.

U.S. Pat. No. 4,464,450 to Teuscher, issued Aug. 7, 1984—Various overcoated electrophotographic imaging members are disclosed including a multilayered imaging member having a substrate, a metal layer, a metal oxide layer, a siloxane blocking layer, an optional intermediate layer, a charge generating binder layer, and a charge transport layer. The intermediate layer between the blocking layer and a generator layer may contain a polyester and have a dry thickness of between about 0.1 micron (1,000 angstroms) and about 5 microns (50,000 angstroms). A polyester du Pont 49000 intermediate layer having a thickness of about 0.05 micrometer (500 angstroms) is described in some of the working examples. The transport layer may contain from about 25 to about 75 percent by weight of a diamine transport material.

U.S. Pat. No. 4,492,746 to Miyakawa et al, issued Jan. 8, 1985—Various electrophotographic imaging members are disclosed including an imaging member containing a polyester dispersed in in PVK to increase adhesion to an electrically conductive substrate. The adhesion of various polyesters and PVK are set forth on tables 1–4 (see columns 9 and 10).

U.S. Pat. No. 4,565,760 to Schank, issued Jan. 21, 1986—Various overcoated electrophotographic imaging members are disclosed including a multilayered imaging member having, between a substrate and a hole transporting layer, a hole injecting electrode layer which includes polyesters such as PE-100 and a charge injecting material. This hole injecting electrode layer has a thickness of about 1 micron to about 20 microns (10,000 angstroms to 200,000 angstroms). Hole transport material containing, for example, 10 to 75 weight percent of a diamine transport material and generating layers containing, for example trigonal selenium in polyvinyl carbazole are also disclosed. A primer for overcoatings is also disclosed which may contain, for example, a polyester such as PE200 and polymethyl methacrylate.

U.S. Pat. No. 4,489,148 to Horgan, issued Dec. 18, 1984—Various electrophotographic imaging members are disclosed including a multilayered imaging member having, between a substrate and a hole transporting layer, an adhesive layer which includes film-forming polymers such as polyesters and the like. An adhesive layer containing du Pont. 49,000 polyester resin is specifically disclosed in the working examples. Typically, the adhesive layer is of a thickness of less than about 0.3 microns (3,000 angstroms). Adhesive layers having a thickness of about 0.05 micrometer, (500 angstroms) are mentioned in column 10, lines 1–17 and 45–48 and Examples III–XVI. Hole transport material containing, for example, 10 to 75 weight percent of a diamine transport material is also disclosed.

U.S. Pat. No. 4,582,772 to Teuscher et al, issued Apr. 15, 1986—An electrophotographic imaging member is disclosed comprising a substrate, a transmissive semiconductive layer selected from the group consisting of indium-tin oxide, cadmium tin oxide, tin oxide, titanium oxides, titanium nitrides, titanium silicides, and mixtures thereof, a photogenerating layer and a charge transport layer, comprising, for example, an electrically active diamine material. An adhesive layer may be employed having a thickness of 0.1 microns (1,000 angstroms). The adhesive layer may contain 49000 polyester from E. I. duPont. Hole transport material containing, for example, 10 to 75 weight percent of a diamine transport material is also disclosed.

U.S. Pat. No. 4,378,418 to Chu, issued Mar. 29, 1983—Various electrophotographic imaging members are disclosed including a multilayered imaging member having a substrate, a hole injecting layer, a combined or separate hole transport and generating layer, and an optional insulating resin overcoating layer which includes film-forming polymers such as polyesters, polyethylene terephthalate, PE-100 and the like. Hole transport material containing, for example, 10 to 75 weight percent of a diamine transport material is also disclosed.

Thus, there is a continuing need for multilayered belt photoreceptors having improved resistance to delamination, cracking and componentleaching.

SUMMARY OF THE INVENTION

It is, therefore, an object of the present invention to provide an improved photoresponsive member which overcomes the above-noted diadvantages.

It is yet another object of the present invention to provide an improved electrophotographic member which exhibits greater resistance to delamination during slitting and cycling.

It is a further object of the present invention to provide a photoconductive imaging member which exhibits improved resistance to componentleaching during liquid development.

It is another object of the present invention to provide an electrophotographic imaging member which maintains seam integrity during cycling.

The foregoing objects and others are accomplished in accordance with this invention by providing a flexible electrophotographic imaging member comprising a flexible substrate having an electrically conductive surface, a hole blocking layer comprising an aminosilane reaction product, an adhesive layer having a thickness between about 200 angstroms and about 900 angstroms consisting essentially of at least one copolyester resin having the following formula:

$$HO\overset{\overset{\displaystyle O}{\|}}{C}-[\text{diacid-diol}]_n-OH$$

wherein the diacid is selected from the group consisting of terephthalic acid, isophthalic acid, and mixtures thereof, the diol comprises ethylene glycol, the mole ratio of diacid to diol is 1:1, n is a number between about 175 and about 350 and the $T_g$ of the copolyester resin is between about 50° C. about 80° C., the aminosilane also being a reaction product of the amino group of the silane with the —COOH and —OH end groups of the copolyester resin, a charge generation layer comprising a film forming polymeric component, and a diamine hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer. Preferably, the diamine hole transport layer comprises from about 35 percent to about 45 percent by weight of an active transport diamine compound.

A photoconductive imaging member of this invention may be prepared by providing a substrate having an electrically conductive surface, applying a charge blocking layer on the electrically conductive layer, applying the adhesive layer of this invention, applying a charge generation binder layer on the blocking layer and applying a diamine charge transfer layer on the charge generation layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like. The electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E. I. du Pont de Nemours & Co. or Melinex available from ICI.

The thickness of the substrate layer depends on numerous factors, including economical considerations, and thus this layer for a flexible belt may be of substantial thickness, for example, over 200 micrometers, or of minimum thickness less than 50 micrometers, provided there are no adverse affects on the final photoconductive device. In one flexible belt embodiment, the thickness of this layer ranges from about 65 micrometers to about 150 micrometers, and preferably from about 75 micrometers to about 125 micrometers for optimum flexibility and minimum stretch when cycled around small diameter rollers, e.g. 12 millimeter diameter rollers. The surface of the substrate layer is preferably cleaned prior to coating to promote greater adhesion of the deposited coating. Cleaning may be effected by exposing the surface of the substrate layer to plasma discharge, ion bombardment and the like.

The conductive layer may vary in thickness over substantially wide ranges depending on the optical transparency and flexibility desired for the electrophotoconductive member. Accordingly, when a flexible photoresponsive imaging device is desired, the thickness of the conductive layer may be between about 20 angstrom units to about 750 angstrom units, and more preferably from about 50 Angstrom units to about 200 angstrom units for an optimum combination of electrical conductivity, flexibility and light transmission. The conductive layer may be an electrically conductive metal layer may be formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. Typical vacuum depositing techniques include sputtering, magnetron sputtering, RF sputtering, and the like. Magnetron sputtering of metals onto a substrate can be effected by a conventional type sputtering module under vacuum conditions in an inert atmosphere such as argon, neon, or nitrogen using a high purity metal target. The vacuum conditions are not particularly critical. In general, a continuous metal film can be attained on a suitable substrate, e.g. a polyester web substrate such as Mylar available from E. I. du Pont de Nemours & Co. with magnetron sputtering. It should be understood that vacuum deposition conditions may all be varied in order to obtain the desired metal thickness. Typical RF sputtering systems such as a modified Materials Research Corporation Model 8620 Sputtering Module on a Welch 3102 Turbomolecular Pump is described in U.S. Pat. No. 3,926,762, the entire disclosure of which is incorporated herein in its entirety. This patent also describes sputtering a thin layer of trigonal selenium onto a substrate which may consist of titanium. Another technique for depositing a metal by sputtering involves the use of planar magnetron cathodes in a vacuum chamber. A metal target plate may be placed on a planar magnetron cathode and the substrate to be coated can be transported over the metal target plate. The cathode and target plate are preferably horizontally positioned perpendicular to the path of substrate travel to ensure that the deposition of target material across the width of the substrate is of uniform thickness. If desired, a plurality of targets and planar magnetron cathodes may be employed to increase throughput, coverage or vary layer composition. Generally, the vacuum chamber is sealed and the ambient atmosphere is evacuated to about $5\times10^{-6}$ mm Hg. This step is immediately followed by flushing the entire chamber with argon at a partial pressure of about $1\times10^{-3}$ mm Hg to remove most residual wall gas impurities. An atmosphere of argon at about $1\times10^{-4}$ mm Hg is introduced into the vacuum chamber in the region of sputtering. Electrical power is then applied to the planar magnetron and translation of the substrate at approximately 3 to about 8 meters per minute is commenced.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. These alloys may be used as a target to deposit a layer comprising a mixture of the evaporated metals. The target may be made of a pressed mixture of the metal powders where alloy combinations may be difficult to achieve. The selected combinations of metal powders are measured, weighed, and thoroughly mixed and compressed to form a sputtering target. The conductive layer may comprise a plurality of metal layers. The multiple layers may, for example, all be vacuum deposited or a thin layer can be vacuum deposited over a thick layer prepared by a different techniques such as by casting. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a conductive carbon black dispersed in a plastic binder as an opaque conductive layer.

Planar magnetrons are commercially available and are manufactured by companies such as the Industrial Vacuum Engineering Company, San Mateo, Calif., Leybold-Heraeus, Germany and U.S., and General Engineering, England. Magnetrons generally are operated at about 500 volts and 120 amps and cooled with water circulated at a rate sufficient to limit the water exit temperature to about 43° C. or less. The use of magnetron sputtering for depositing a metal layer on a substrate is described, for example, in U.S. Pat. No. 4,332,276 to Mecket et al, the disclosure of this patent being incorporated herein in its entirety. A typical electrical conductivity for conductive layers for electrophotographic imaging members in slow speed copiers is about $10^2$ to $10^3$ ohms/square.

After deposition of the metal metal layer, a hole blocking layer may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be organic or inorganic and may be deposited by any suitable technique. For example, if the blocking layer is soluble in a solvent, it may be applied as a solution and the solvent can subsequently be removed by any conventional method such as by drying. Typical blocking layers include polyvinylbutyral, organosilanes, epoxy resins, polyesters, polyamides, polyurethanes, pyroxyline vinylidene chloride resin, silicone resins, fluorocarbon resins and the like containing an organo metallic salt. Other blocking layer materials include nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,291,110, 4,338,387, 4,286,033 and 4,291,110. The disclosures of U.S. Pat. Nos. 4,338,387, 4,286,033 and 4,291,110 are incorporated herein in their entirety. A preferred blocking layer comprises a reaction product between a hydrolyzed silane and the oxidized surface of a metal ground plane layer. The oxidized surface inherently forms on the outer surface of most metal ground plane layers when exposed to air after deposition. This combination enhances electrical stability at low RH. The hydrolyzed silane has the general formula:

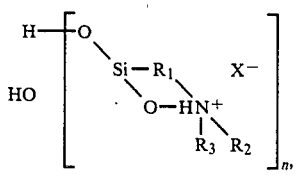

I or

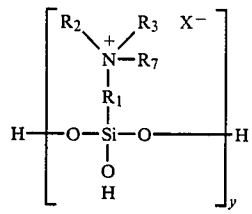

II or mixtures thereof, wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1, 2, 3 or 4, and y is 1, 2, 3 or 4.

The imaging member is preferably prepared by depositing on the metal oxide layer of a metal conductive anode layer, a coating of an aqueous solution of the hydrolyzed aminosilane at a pH between about 4 and about 10, drying the reaction product layer to form a siloxane film and applying an adhesive layer of this invention, and thereafter applying electrically operative layers, such as a photogenerator layer and a hole transport layer, to the siloxane film.

The hydrolyzed silane may be prepared by hydrolyzing a silane having the following structural formula:

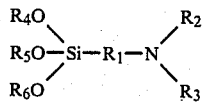

wherein $R_1$ is an alkylidene group containing 1 to 20 carbon atoms, $R_2$ and $R_3$ are independently selected from H, a lower alkyl group containing 1 to 3 carbon atoms, a phenyl group and a poly(ethylene)amino or ethylene diamine group, and $R_4$, $R_5$ and $R_6$ are independently selected from a lower alkyl group containing 1 to 4 carbon atoms. Typical hydrolyzable silanes include 3-aminopropyl triethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

If $R_1$ is extended into a long chain, the compound becomes less stable. Silanes in which $R_1$ contains about 3 to about 6 carbon atoms are preferred because the molecule is more stable, is more flexible and is under less strain. Optimum results are achieved when $R_1$ contains 3 carbon atoms. Satisfactory results are achieved when $R_2$ and $R_3$ are alkyl groups. Optimum smooth and uniform films are formed with hydrolyzed silanes in which $R_2$ and $R_3$ are hydrogen. Satisfactory hydrolysis of the silane may be effected when $R_4$, $R_5$ and $R_6$ are alkyl groups containing 1 to 4 carbon atoms. when the alkyl groups exceed 4 carbon atoms, hydrolysis becomes impractically slow. However, hydrolysis of silanes with alkyl groups containing 2 carbon atoms are preferred for best results.

During hydrolysis of the amino silanes described above, the alkoxy groups are replaced with hydroxyl groups. As hydrolysis continues, the hydrolyzed silane takes on the following intermediate general structure:

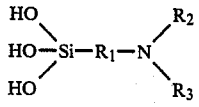

After drying, the siloxane reaction produce film formed from the hydrolyzed silane contains larger molecules in which n is equal to or greater than 6. The reaction product of the hydrolyzed silane may be linear, partially crosslinked, a dimer, a trimer, and the like.

The hydrolyzed silane solution may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product films may be achieved with solutions containing from about 0.1 percent by weight to about 1.5 percent by weight of the silane based on the total weight of the solution. A solution containing from about 0.05 percent by weight to about 0.2 percent by weight silane based on the total weight of solution are preferred for stable solutions which form uniform reaction product layers. It is important that the pH of the solution of hydrolyzed silane be carefully controlled to obtain optimum electrical stability. A solution pH between about 4 to about 10 is preferred. Thick reaction product layers are difficult to form at solution pH greater than about 10. Moreover, the reaction product film flexibility is also adversely affected when utilizing solutions having a pH greater than about 10. Further, hydrolyzed silane solutions having a pH greater than about 10 or less than about 4 tend to severely corrode metallic conductive anode layers such as those containing aluminum during storage of finished photoreceptor products. Optimum reaction product layers are achieved with hydrolyzed silane solutions having a pH between about 7 and about 8, because inhibition of cycling-up and cycling-down characteristics of the resulting treated photoreceptor are maximized. Some tolerable cycling-down has been observed with hydrolyzed amino silane solutions having a pH less than about 4.

Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorsilicic acid, Bromocresol Green, Bromophenol Blue, p-toluene sulfonic acid and the like.

If desired, the aqueous solution of hydrolyzed silane may also contain additives such as polar solvents other than water to promote improved wetting of the metal oxide layer of metallic conductive anode layers. Improved wetting ensures greater uniformity of reaction between the hydrolyzed silane and the metal oxide layer. Any suitable polar solvent additive may be employed. Typical polar solvents include methanol, ethanol, isopropanol, tetrahydrofuran, methylcellosolve, ethylcellosolve, ethoxyethanol, ethylacetate, ethylformate and mixtures thereof. Optimum wetting is achieved with ethanol as the polar solvent additive. Generally, the amount of polar solvent added to the hydrolyzed silane solution is less than about 95 percent based on the total weight of the solution.

Any suitable technique may be utilized to apply the hydrolyzed silane solution to the metal oxide layer of a metallic conductive anode layer. Typical application techniques include spraying, dip coating, roll coating, wire wound rod coating, and the like. Although it is preferred that the aqueous solution of hydrolyzed silane be prepared prior to application to the metal oxide layer, one may apply the silane directly to the metal oxide layer and hydrolyze the silane in situ by treating the deposited silane coating with water vapor to form a hydrolyzed silane solution on the surface of the metal oxide layer in the pH range described above. The water vapor may be in the form of steam or humid air. Generally, satisfactory results may be achieved when the reaction product of the hydrolyzed silane and metal oxide layer forms a layer having a thickness between about 20 Angstroms and about 2,000 Angstroms. As the reaction product layer becomes thinner, cycling instability begins to increase. As the thickness of the reaction product layer increases, the reaction product layer becomes more non-conducting and residual charge tends to increase because of trapping of electrons and thicker reaction product films tend to become brittle. A brittle coating is, of course, not suitable for flexible photoreceptors, particularly in high speed, high volume copiers, duplicators and printers.

Drying or curing of the hydrolyzed silane upon the metal oxide layer should be conducted at a temperature greater than about room temperature to provide a reaction product layer having more uniform electrical properties, more complete conversion of the hydrolyzed silane to siloxanes and less unreacted silanol. Generally, a reaction temperature between about 100° C. and about 150° C. is preferred for maximum stabilization of electrochemical properties. The temperature selected depends to some extent on the specific metal oxide layer utilized and is limited by the temperature sensitivity of the substrate. Reaction product layers having optimum electrochemical stability are obtained when reactions are conducted at temperatures of about 135° C. The reaction temperature may be maintained by any suitable technique such as ovens, forced air ovens, radiant heat lamps, and the like.

The reaction time depends upon the reaction temperatures used. Thus less reaction time is required when higher reaction temperatures are employed. Generally, increasing the reaction time increases the degree of cross-linking of the hydrolyzed silane. Satisfactory results have been achieved with reaction times between about 0.5 minute to about 45 minutes at elevated temperatures. For practical purposes, sufficient cross-linking is achieved by the time the reaction product layer is dry provided that the pH of the aqueous solution is maintained between about 4 and about 10.

The reaction may be conducted under any suitable pressure including atmospheric pressure or in a vacuum. Less heat energy is required when the reaction is conducted at sub-atmospheric pressures.

One may readily determine whether sufficient condensation and cross-linking has occurred to form a siloxane reaction product film having stable electric chemical properties in a machine environment by merely washing the siloxane reaction produce film with water, toluene, tetrahydrofuran, methylene chloride or cyclohexanone and examining the washed siloxane reaction product film to compare infrared absorption of Si—O—wavelength bands between about 1,000 to about 1,200 $cm^{-1}$. If the Si—O—wavelength bands are visible, the degree of reaction is sufficient, i.e. sufficient condensation and cross-linking has occurred, if peaks in the bands do not diminish from one infrared absorption test to the next. It is believed that the partially polymerized reaction product contains siloxane and silanol moieties in the same molecule. The expression "partially polymerized" is used because total polymerization is normally not achievable even under the most severe drying or curing conditions. The hydrolyzed silane appears to react with metal hydroxide molecules in the pores of the metal oxide layer. This siloxane coating is described in U.S. Pat. No. 4,464,450 to L. A. Teuscher, the disclosure of this application being incorporated herein in its entirety.

The blocking layer should be continuous and have a thickness of less than about 0.5 micrometer because greater thicknesses may lead to undesirably high residual voltage. A blocking layer of between about 0.005 micrometer and about 0.3 micrometer (50 Angstroms-3000 Angstroms) is preferred because charge neutralization after the exposure step is facilitated and optimum electrical performance is achieved. A thickness of between about 0.03 micrometer and about 0.06 micrometer is preferred for metal oxide layers for optimum electrical behavior. Optimum results are achieved with a siloxane blocking layer. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. Generally, a weight ratio of blocking layer material and solvent of between about 0.05:100 and about 0.5:100 is satisfactory for spray coating.

An adhesive layer is applied to the hole blocking layer. Adhesive layers containing a polyester resin have been described in the prior art. One prior art polyester resin adhesive layer, known as du Pont 49,000 (available from duPont de Nemours & Co.), is a linear saturated copolyester reaction product of four diacids and ethylene glycol. The molecular structure of this linear saturated copolyester is represented by the following:

$$HO\overset{O}{\overset{\|}{C}}-[\text{diacid-diol}]_n-OH$$

where the mole ratio of diacid of ethylene glycol in the copolyester is 1:1. The diacids are terephthalic acid, isophthalic acid, adipic acid and azelaic acid. The mole ratio of terephthalic acid to isophthalic acid to adipic acid to azelaic acid is 4:4:1:1. The molar structures of these acids and ethylene glycol are:

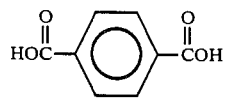
terephthalic acid

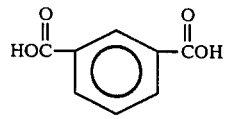
isophthalic acid

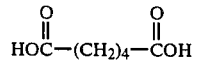
adipic acid

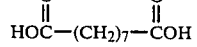
azelaic acid

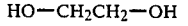
ethylene glycol

The du Pont 49,000 linear saturated copolyester consists of alternating monomer units of ethylene glycol and four randomly sequenced diacids in the above indicated ratio and has a weight average molecular weight of about 70,000 and a $T_g$ of about 32° C. It is believed that the presence of the diacids containing alkylene groups in du Pont 49,000 linear saturated copolyester adhesive layers contribute to the delamination of multilayered photoreceptors during transport over small diameter rollers.

The polyester adhesive layers of this invention comprise at least about 90 percent by weight based on the total weight of the adhesive layer of a copolyester resin having the following structural formula:

$$HO\overset{O}{\overset{\|}{C}}-[\text{diacid-diol}]_n-OH$$

wherein the diacid is selected from the group consisting of terephthalic acid, isophthalic acid, and mixtures thereof, the diol is selected from the group consisting of ethylene glycol, 2,2-dimethyl propane and mixtures thereof, the ratio of diacid to diol is 1:1, n is a number between about 175 and about 350 and the $T_g$ of the copolyester resin is between about 50° C. about 80° C. Typical polyester resins having the above structure include, for example, Vitel PE-100, Vitel PE-200, Vitel PE-200D, and Vitel PE-222, all available from Goodyear Tire and Rubber Co. The adhesive layer comprising this polyester resin is applied to the blocking layer. The adhesive layer of this invention should be continuous and preferably, has a dry thickness between about 200 micrometers and about 900 micrometers and more preferably between about 400 micrometers and about 700 micrometers. At thickness of less than about 200 angstroms, the adhesion between the generating layer and the blocking layer is poor and delamination occurs when the belt is transported over small diameter supports such as rollers and curved skid plates. When the thickness of the adhesive layer of this invention is greater than about 900 angstroms, excessive residual charge buildup is observed during extended cycling. Any suitable solvent or solvent mixtures may be employed to form a coating solution of the polyester. Typical solvents include terahydrofuran, toluene, methylene chloride, cyclohexanone, and the like, and mixtures thereof. Generally, to achieve a continuous adhesive layer thickness of about 900 angstroms or less by gravure coating techniques, it is necessary that the solids concentration be between about 2 percent and about 5 percent by weight based on the total weight of the coating mixture of polyester and solvent. However, any other suitable and conventional technique may be utilized to mix and thereafter apply the adhesive layer coating mixture of this invention to the charge blocking layer. Typical application techniques include spraying, dip coating, roll coating, wire wound rod coating, and the like. Drying of the deposited coating may be effected by any suitable conventional technique such as oven drying, infra red radiation drying, air drying and the like.

The adhesive layers of this invention should contain at least about 90 percent by weight, based on the total weight of the adhesive layer, of the copolyester resin of this invention to achieve adequate adhesive strength for applications involving transport of the photoreceptor belt over small diameter rollers, e.g. 19 mm, and blade cleaning.

One example of a polyester resin employed in the adhesive layers of this invention is a copolyester available from Goodyear Tire & Rubber Co. as Vitel PE-100. This polyester resin is a linear saturated copolyester of two diacids and ethylene glycol. The molecular structure of this linear saturated copolyester is represented by the following:

$$\mathrm{HO}\overset{\overset{\mathrm{O}}{\|}}{\mathrm{C}}\text{—[diacid-ethylene glycol]}_n\text{—OH}$$

where the ratio of diacid to ethylene glycol in the copolyester is 1:1. The diacids are terephthalic acid and isophthalic acid. The ratio of terephthalic acid to isophthalic acid is 3:2. The molecular structures of these acids and ethylene glycol are present above. The Vitel PE-100 linear saturated copolyester consists of alternating monomer units of ethylene glycol and two randonly sequenced diacids in the above indicated ratio and has a molecular weight of about 50,000 and a $T_g$ of about 71° C.

Another polyester resin adhesive layers of this invention is available from Goodyear Tire & Rubber Co. as Vitel PE-200. This polyester resin is a linear saturated copolyester of two diacids and two diols. The molecular structure of this linear saturated copolyester is represented by the following:

$$\mathrm{HO}\overset{\overset{\mathrm{O}}{\|}}{\mathrm{C}}\text{—]Diacid-Diol]}_n\text{—OH}$$

where the ratio of diacid to ethylene glycol in the copolyester is 1:1. The diacids are tetephthalic acid and isophthalic acid. The ratio of terephthalic acid to isophthalic acid is 1.2:1. The molecular structures of these acids and ethylene glycol are presented above. The two diols are ethylene glycol and 2,2-dimethyl Propane Diol. The ratio of ethylene glycol to dimethyl propane diol is 1.33:1. The molecular structure of ethylene glycol is presented above and the molecular structure of dimethyl propane diol is as follows:

$$\text{2,2-Dimethyl Propane Diol } \mathrm{HOCH_2}\text{—}\overset{\overset{\mathrm{CH_3}}{|}}{\underset{\underset{\mathrm{CH_3}}{|}}{\mathrm{C}}}\text{—}\mathrm{CH_2OH}$$

The Goodyear PE-200 linear saturated copolyester consists of randomly alternating monomer units of the two diacids and the two diols in the above indicated ratio and has a molecular weight of about 45,000 and a $T_g$ of about 67° C.

The diacids from which the polyester resins of this invention are derived are terephthalic and isophthalic acids only. The diols from which the polyester resins of this invention are derived include ethylene glycol. Other glycols such as 2,2-dimethyl propane diol may also be employed in combination with ethylene glycol to prepare the polyester resins of this invention. Bonding of the adhesive layer polyester and aminosiloxane blocking layer is believed to be derived by formation of an acid-base interfacial bond and further supplemented by strong nucleophilic interaction to form an extremely durable photoreceptor.

Any suitable photogenerating layer may be applied to the blocking layer or intermediate layer if one is employed, which can then be overcoated with a contiguous hole transport layer as described. Examples of photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vadadyl phthalocyanine and copper phthalocyanine, quinacridones available from DuPont under the tradename Monastral Red, Monastral violet and Monastral Red Y, Vat orange 1 and Vat orange 3 trade names for dibromo ant anthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189, the entire disclosure thereof being incorporated herein by reference. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired. Charge generating binder layer comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-telluriumarsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infra-red light.

Numerous inactive resin materials may be employed in the photogenerating binder layer including those described, for example, in U.S. Pat. No. 3,121,006, the entire disclosure of which is incorporated herein by reference. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like. These polymers may be block, random or alternating copolymers.

It is believed that the presence of polymers in the photogenerating binder layer contributes to polymer chain interpenetration with chains from the copolyester resins in the adhesive layer of this invention thereby enhancing resistance to delamination during transport over small diameter rollers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

The active charge transport layer may comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to a wavelength of light useful in xerography, e.g. 4000 angstroms to 9000 angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active transport material need not be transmitting in the wavelength region of use. The charge transport layer in conjunction with the generation layer in the instant invention is a material which is an insulator to the extent that an electrostatic charge placed on the transport layer is not conducted in the absence of illumination.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

An especially preferred transport layer employed in one of the two electrically operative layers in the multilayer photoconductor of this invention comprises from about 35 percent to about 45 percent by weight of at least one charge transporting aromatic amine compound, and about 65 percent to about 55 percent by weight of a polymeric film forming resin in which the aromatic amine is soluble.

The charge transport layer forming mixture preferably comprises an aromatic amine compound of one or more compounds having the general formula:

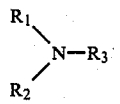

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups, and the like. Typical aromatic amine compounds that are represented by this structural formula include:

I. Triphenyl amines such as:

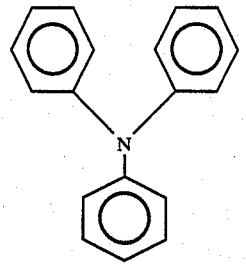

II. Bis and poly triarylamines such as:

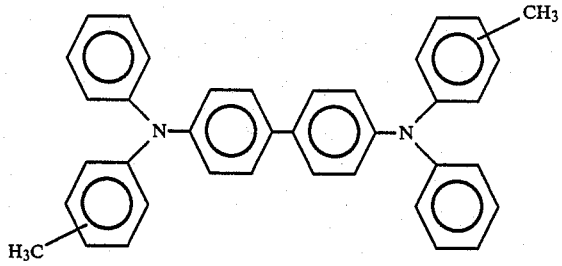

Bis arylamine ethers such as:

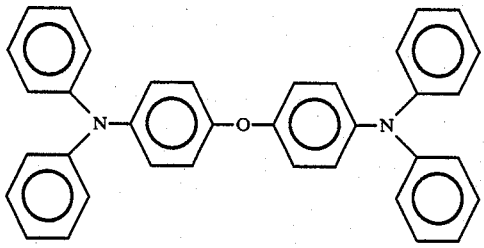

and

IV. Bis alkyl-arylamines such as:

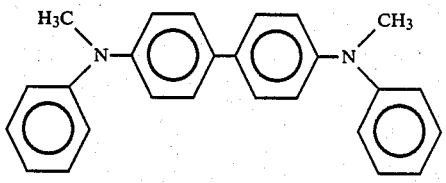

A preferred aromatic amine compound has the general formula:

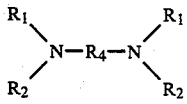

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free form electron withdrawing groups such as $NO_2$ groups, CN groups, and the like.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4′-4″-bis(diethylamino)-2′,2″-dimethyltriphenylmethane, N,N′-bis(alkylphenyl)-[1,1′-biphenyl]-4,4′-diamine wherein the alkyl is, for example, methyl, ethyl, propyl, n-butyl, etc., N,N′-diphenyl-N,N′-bis(chlorophenyl)-[1,1′-biphenyl]-4,4′-diamine, N,N′-diphenyl-N,N′-bis(3″-methylphenyl)-(1,1′-biphenyl)-4,4′-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000.

The preferred electrically inactive resin materials are polycarbonate resins have a molecular weight from about 20,000 to about 120,000, more preferably from about 50,000 to about 100,000. The materials most preferred as the electrically inactive resin material is poly(4,4′-dipropylidene-diphenylene carbonate) with a molecular weight of from about 35,000 to about 40,000, available as Lexan 145 from General Electric Company; poly(4,4′-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G. and a polycarbonate resin having a molecular weight of from about 20,000 to about 50,000 available as Merlon from Mobay Chemical Company. Methylene chloride solvent is a desirable component of the charge transport layer coating mixture for adequate dissolving of all the components and for its low boiling point.

Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety.

An especially preferred multilayered photoconductor comprises a charge generation layer comprising a binder layer of photoconductive material and a contiguous hole transport layer of a polycarbonate resin material having a molecular weight of from about 20,000 to about 120,000 having dispersed therein from about 25 to about 75 percent by weight of one or more compounds having the general formula:

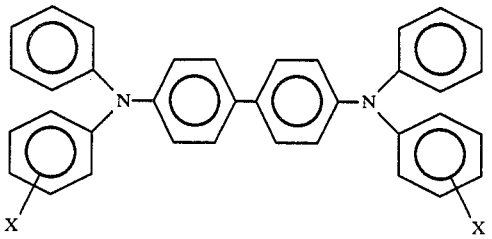

wherein X is selected from the group consisting of an alkyl group, having from 1 to about 4 carbon atoms and chlorine, the photoconductive layer exhibiting the capability of photogeneration of holes and injection of the holes and the hole transport layer being substantially non-absorbing in the spectral region at which the photoconductive layer generates and injects photogenerated holes but being capable of supporting the injection of photogenerated holes from the photoconductive layer and transporting the holes through the hole transport layer.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used.

Generally, the thickness of the hole transport layer is between about 5 to about 100 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

Other layers such as conventional ground strips comprising, for example, conductive particles dispersed in a film forming binder may be applied to one edge of the photoreceptor in contact with the zirconium layer, blocking layer, adhesive layer or charge generating layer.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

BRIEF DESCRIPTION OF THE DRAWINGS

A more complete understanding of the process and device of the present invention can be obtained by reference to the accompanying drawings wherein.

DETAILED DESCRIPTION OF THE DRAWINGS

Figure 1:
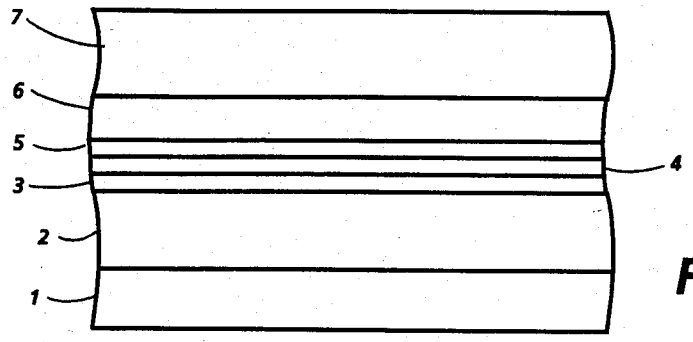
FIG. 1 is a schematic illustration of a multilayered photoreceptor.

Referring to FIG. 1, a photoreceptor is shown having an anticurl backing coating 1, a supporting substrate 2, an electrically conductive ground plane 3, an aminosiloxane hole blocking layer 4, an adhesive layer 5, a charge generating layer 6, and a charge transport layer 7.

The electrophotographic member of the present invention may be employed in any suitable and conventional electrophotographic imaging process which utilizes negative charging prior to imagewise exposure to activating electromagnetic radiaion. When the imaging surface of an electrophotographic member is uniformly charged with a negative charge and imagewise exposed to activating electromagnetic radiation, Conventional positive or reversal development techniques may be employed to form a marking material image on the imaging surface of the electrophotographic imaging member of this invention. Thus, by applying a suitable electrical bias and selecting toner having the appropriate polarity of electrical charge, one may form a toner image in the negatively charged areas or discharged areas on the imaging surface of the electrophotographic member of the present invention. More specifically, for positive development, positively charged toner particles are attracted to the negatively charged electrostatic areas of the imaging surface and for reversal development, negatively charged toner particles are attracted to the discharged areas of the imaging surface.

The electrophotographic member of the present invention exhibits greater resistance to delamination during slitting and cycling, improved resistance to component leaching during liquid development during cycling and higher seam integrity during cycling.

The invention will now be described in detail with respect to the specific preferred embodiments thereof, it being understood that these examples are intended to be illustrative only and that the invention is not intended to be limited to the materials, conditions, process parameters and the like recited herein. All parts and percentages are by weight unless otherwise indicated.

EXAMPLE I

A polyester film was vacuum coated with a titanium layer having a thickness of about 200 Angstroms. The exposed surface of the titanium layer was oxidized by exposure to oxygen in the ambient atmosphere. A siloxane hole blocking layer was prepared by applying a 0.22 percent (0.001 mole) solution of 3-aminopropyl triethoxylsilane to the oxidized surface of the aluminum layer with a gravure applicator. The deposited coating was dried at 135° C. in a forced air oven to form a layer having a thickness of 450 Angstroms. A coating of polyester resin, (49000, available from the E. I. du Pont de Nemours & Co.) was applied with a gravure applicator to the siloxane coated base. The polyester resin coating was dried to form a film having a thickness of about 0.05 micrometer. A slurry coating solution of 3 percent by weight sodium doped trigonal selenium having a particle size of about 0.05 micrometer to 0.2 micrometer and about 6.8 percent by weight polyvinylcarbazole and 2.3 percent by weight N,N'-diphenyl-N,N'-bis(3 methyl phenyl)-[1,1'-biphenyl]-4,4' diamine in a 1:1 by volume mixture of tetrahydrofuran and toluene was extrusion coated onto the polyester coating to form a layer having a wet thickness of 26 micrometers. The coated member was dried at 135° C. in a forced air oven to form a layer having a thickness of 2.5 micrometers. This coated web was divided into 6 different lots for coating of transport layers having six different loadings of N,N'-diphenyl-N,N'-bis(3-methylphenyl)-[1,1'-biphenyl]-4,4'-diamine in a polycarbonate resin having a molecular weight from about 50,000 to about 100,000 available from Farbenfabriken Bayer A. G. The six different charge transport layer were formed on the charge generator layers of the six different lots by applying a solution of Makrolon, a polycarbonate resin having a molecular weight from about 50,000 to about 100,000 available from Farbenfabriken Bayer A. G. and N,N'-diphenyl-N,N'-bis(3-methylphenyl)-[1,1'-biphenyl]-4,4'-diamine dissolved in methylene chloride to ultimately provide 50, 40, 30, 20, 10, and 5 percent by weight loadings of N,N'-diphenyl-N,N'-bis(3-methylphenyl)-[1,1'-biphenyl]-4,4'-diamine, respectively, in the dried transport layers of the six lots. The transport layers were coated on top of the generator layer with a Bird applicator and dried at temperature of about 135° C. to form 24 micrometer thick dry layers of hole transporting material. An anti curl backing coating was also applied.

EXAMPLE II

Sample photoreceptors from each of the six lots prepared as described in Example I were wrapped around 180° of 0.8" diameter rollers and kept in contact for about three weeks with nonwoven fabric soaked with mineral oil. Surface cracking was observed in the samples containing 50 percent, 40 percent, and 30 percent loadings of N,N'-diphenyl-N,N'-bis(3-methylphenyl)-[1,1'-biphenyl]-4,4'-diamine whereas no surface cracking was observed for samples containing 20 percent, 10 percent, 5 percent loadings.

EXAMPLE III

Figure 2:
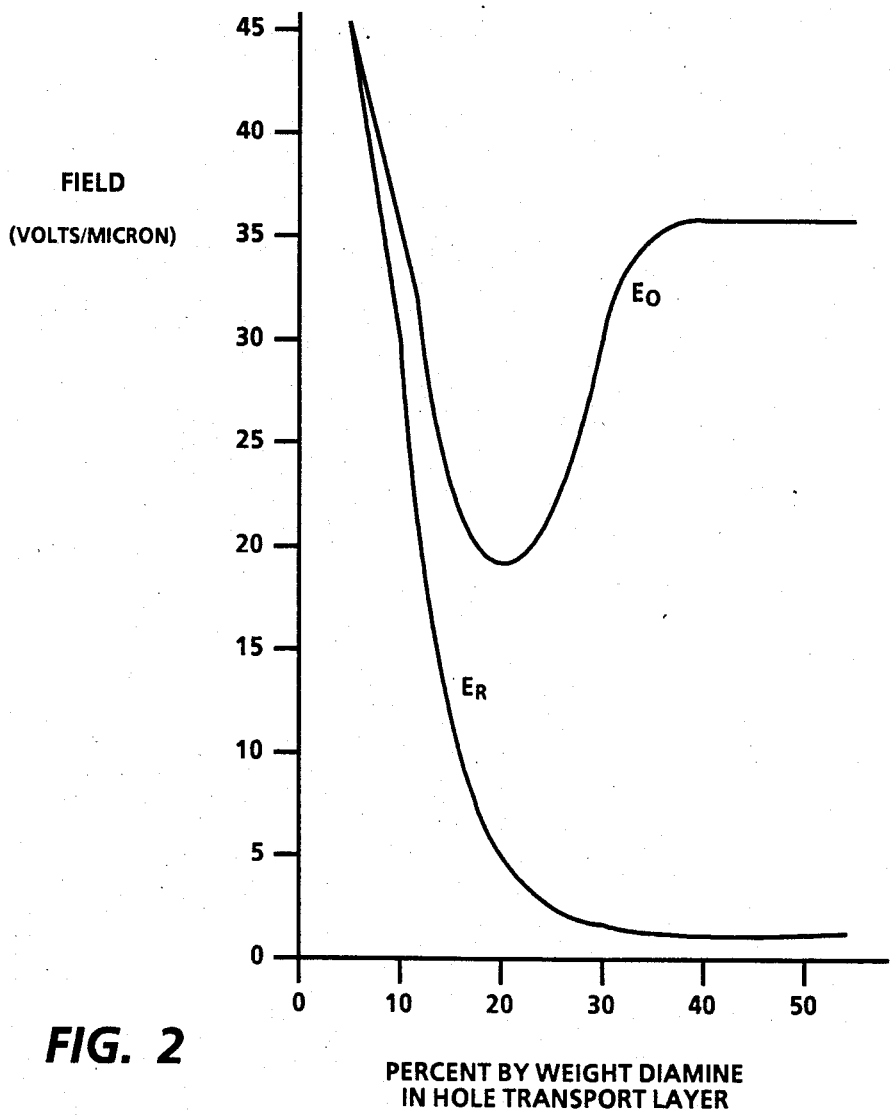
FIG. 2 is a graph of surface potential $E_o$ and residual potential $E_R$ (in terms of field strength and volts/micron) plotted against concentration of diamine in a hole transport layer.
Figure 3:
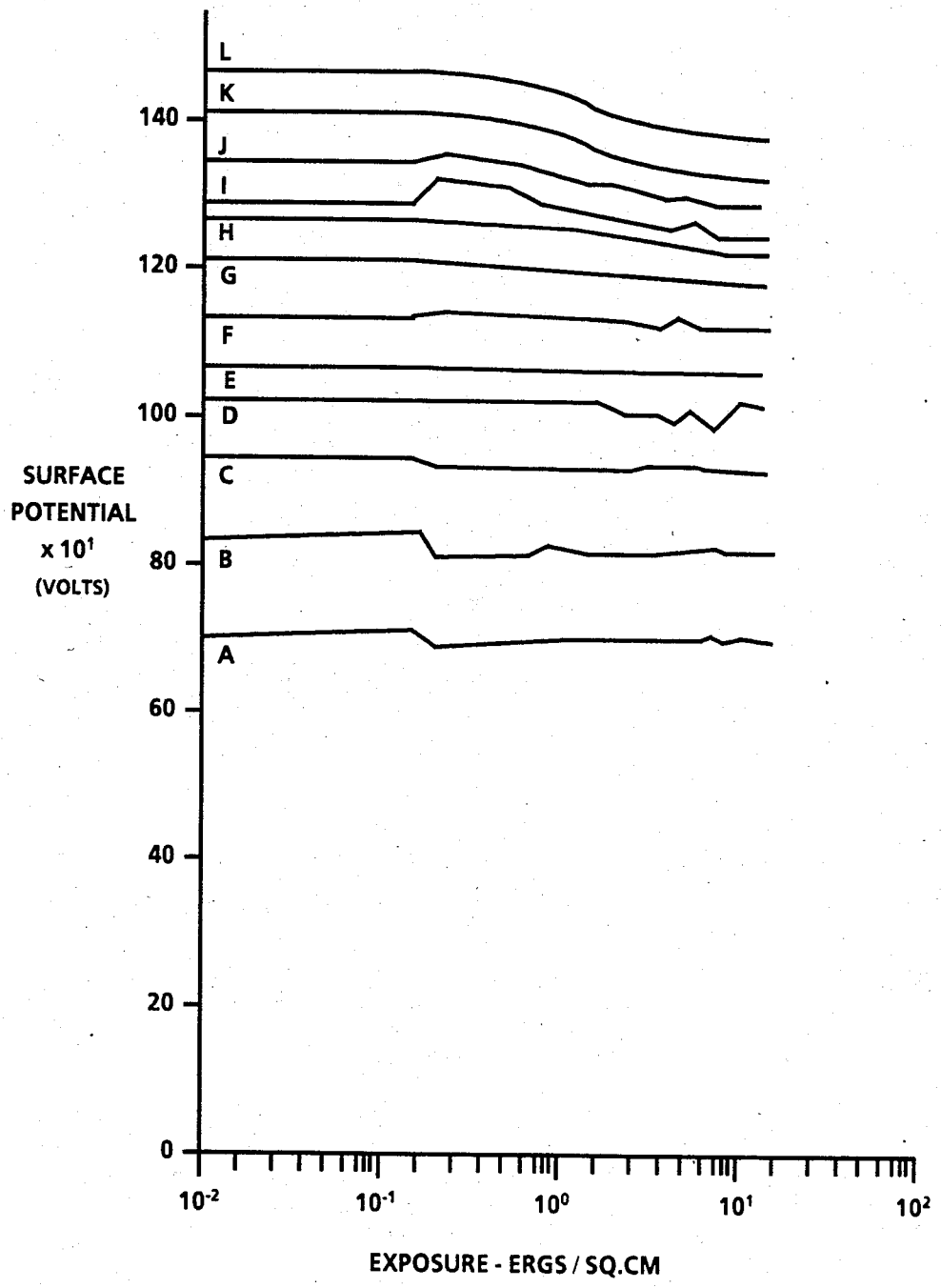
FIGS. 3 through 7 are graphs illustrating surface potential plotted against exposure for photoreceptors having different concentrations of diamine in a hole transport layer.
Figure 4:
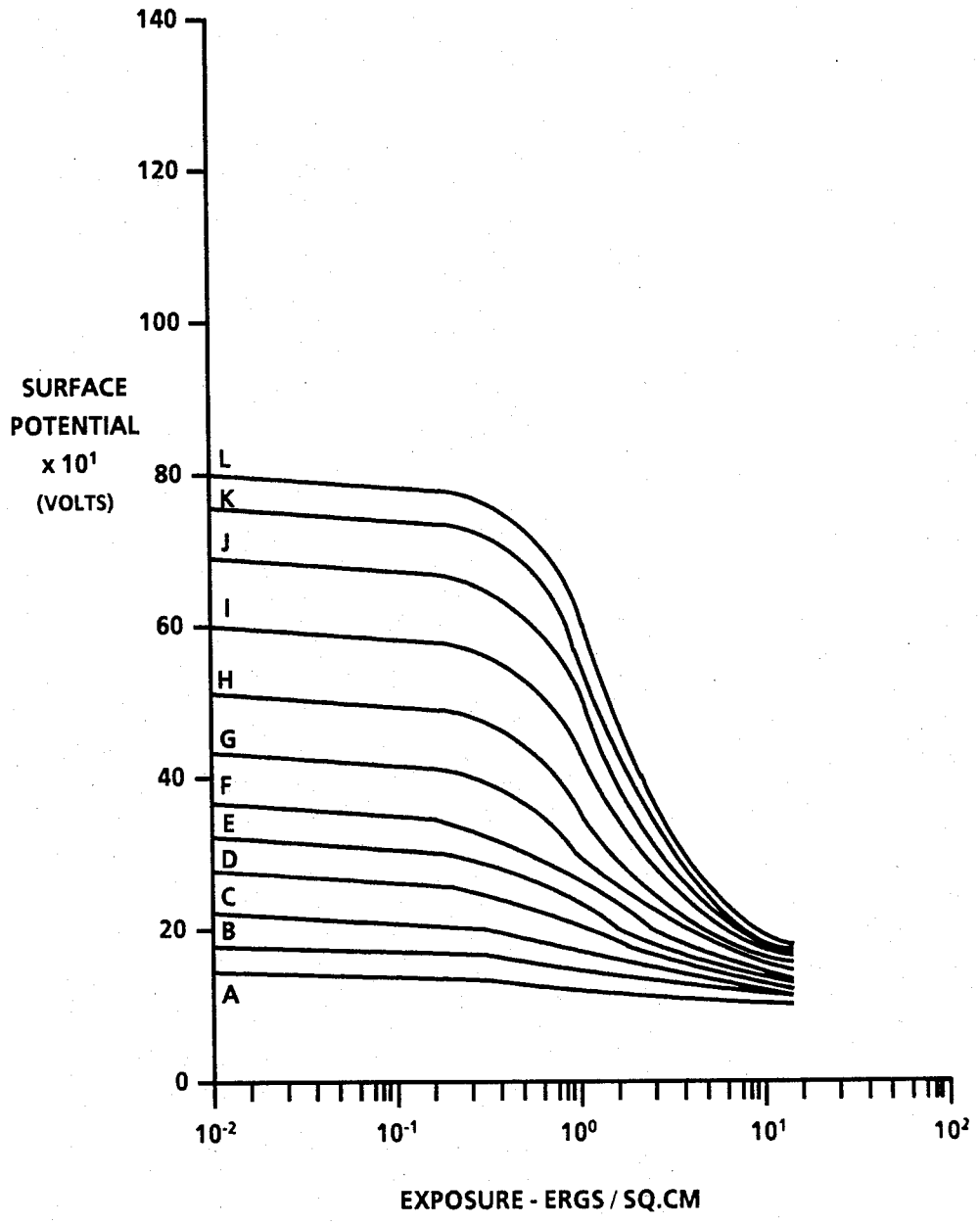
Figure 5:
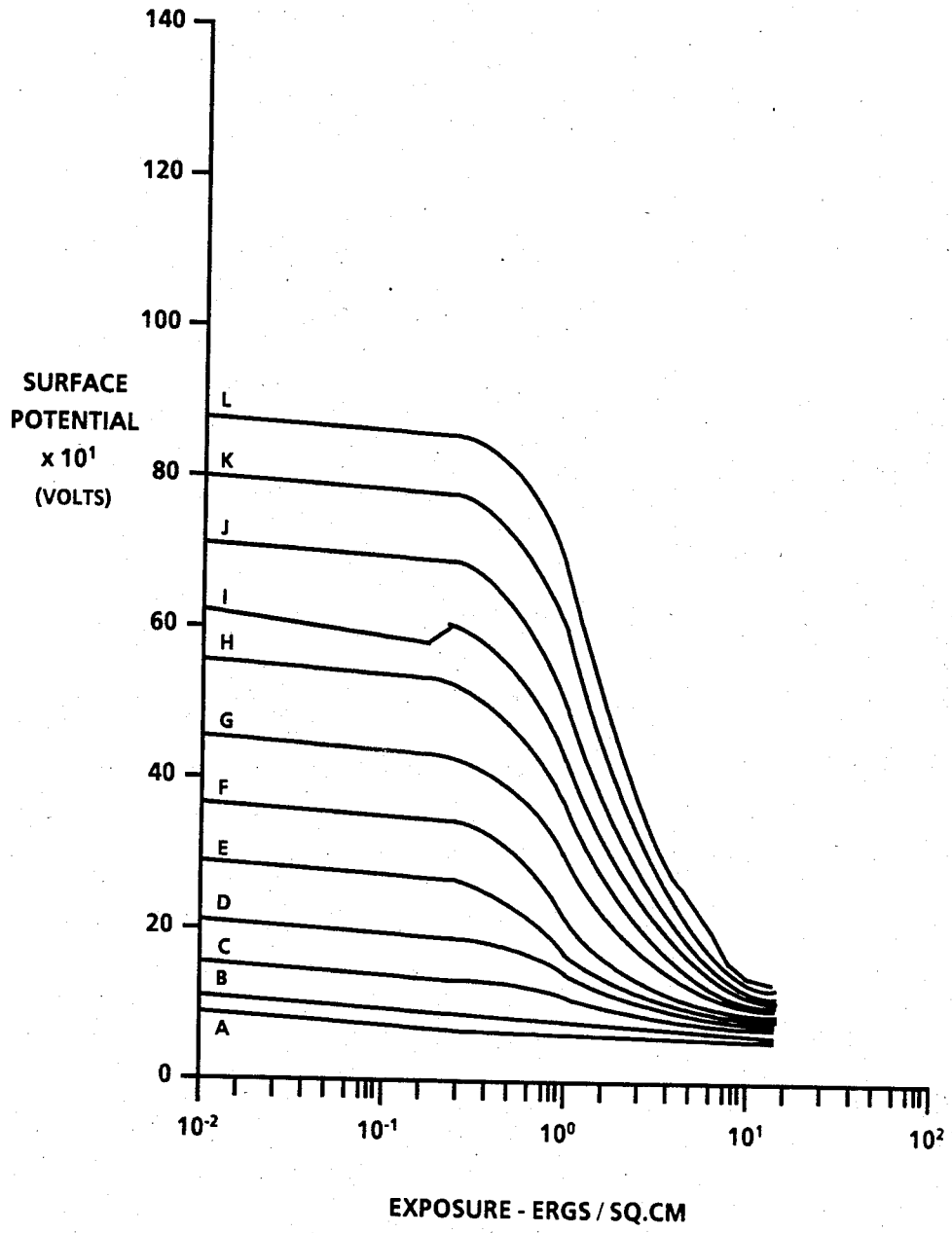
Figure 6:
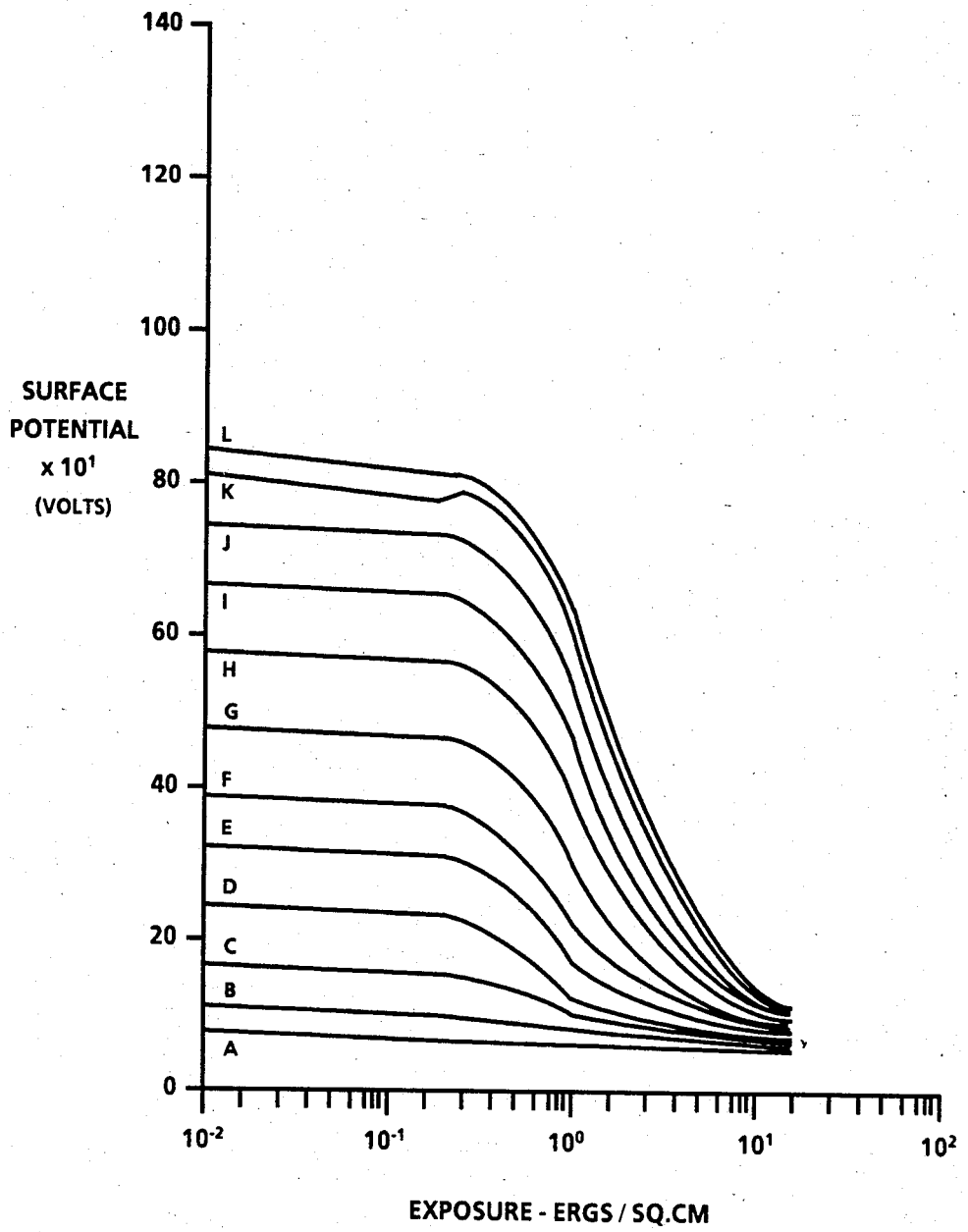
Figure 7:
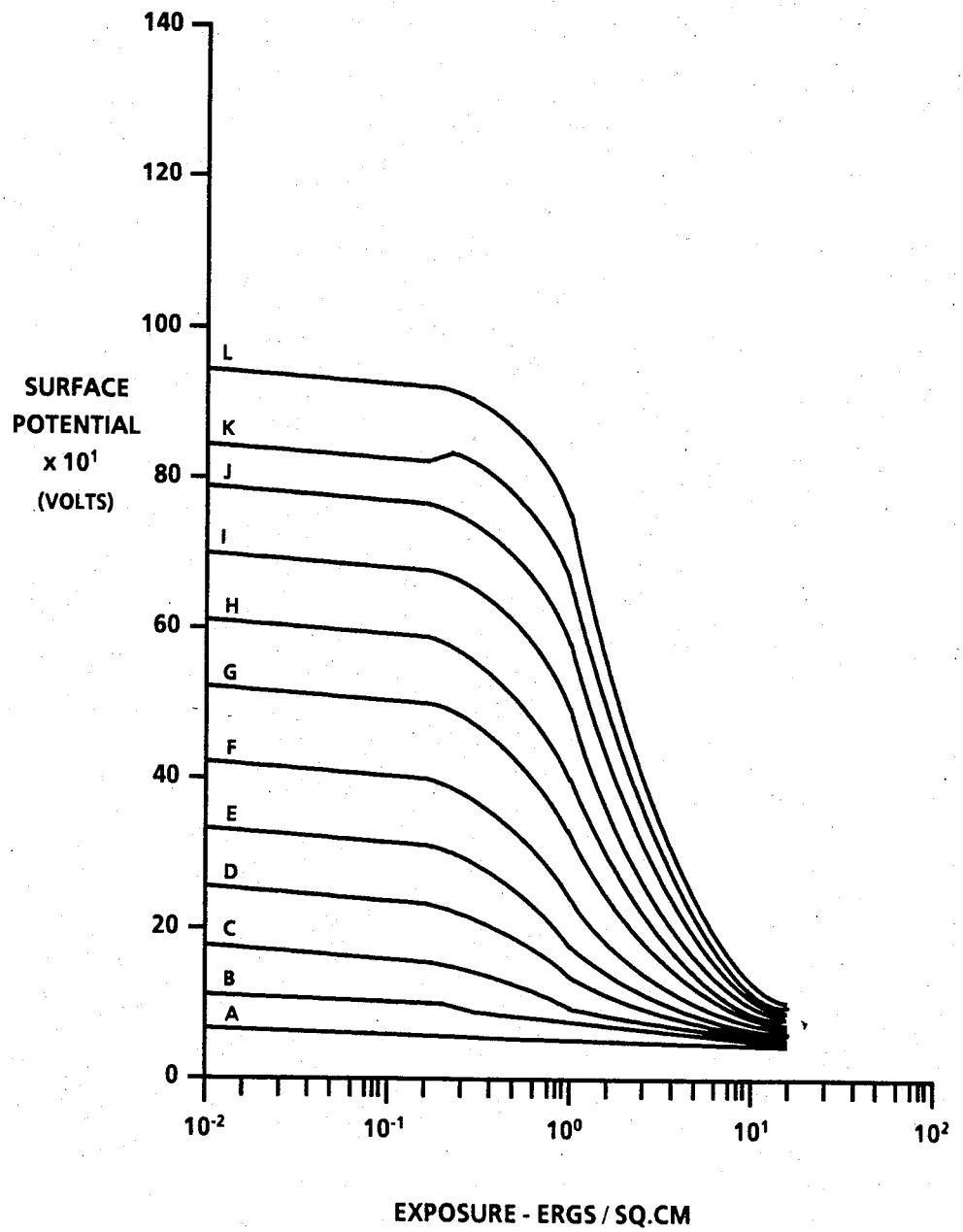

Sample photoreceptors from each of the six lots prepared as described in Example I were tested in a xerographic scanner testing device comprising a cylindrical aluminum drum having a diameter of about 3.25 inches and having a corotron, erase lamp and a probe mounted around the periphery of the drum. The photoreceptor samples were taped to the drum. The drum was driven at a constant surface speed of 3.43 inches per second. Each photoreceptor was rested in the dark overnight prior to charging. Each was then negatively corona charged in the dark to a development potential of −800 volts. The corotron was controlled by a Monroe Coronatrol. Each photoreceptor was thereafter discharged (erased) by exposure to about 250 erg/cm$^2$ of light. Each photoreceptor was then subjected to the equivalent life of 100 imaging cycles. The surface potential $E_o$ and the residual potential $E_R$ were measured ater 100 cycles for each photoreceptor and plotted (see FIG. 2) in terms of field strength and volts/micron. The measurements were made with a probe, adjacent to the photoreceptor and corotron, 0.3 seconds after charging. The probe was connected to a Keithly 610B Electrometer, the output of which was transmitted to a a Hewlett Packard Recorder Model 7402A. As shown in FIG. 2, the photoreceptor with a 30 percent loading of N,N'-diphenyl-N,N'-bis(3-methylphenyl)-[1,1'-biphenyl]-4,4'-diamine exhibited a slight (but measurable) deterioration in $E_o$ and $E_R$ from ideal electrical properties. However, no significant differences in the electrical properties were observed for photoreceptor with between 40 and 50 percent loadings of N,N'-diphenyl-N,N'-bis(3-methylphenyl)-[1,1'-biphenyl]-4,4'-diamine.

EXAMPLE IV

Sample photoreceptors from each of the six lots prepared as described in Example I were tested in a xerographic scanner device which drove the photoreceptor samples (taped to an aluminum cylinder having a diameter of 9.5 inches) at a constant speed of 30 inches per second. A corotron, exposure light, erase light and probes were mounted around the periphery of each mounted photoreceptor sample. The relative locations of the probes are indicated in Table 1 below:

TABLE 1

| ELEMENT | ANGLE | POSITION | DISTANCE FROM PHOTORECEPTOR |
|---|---|---|---|
| CHARGE | 0 | 0 | Pins 18 mm/ Shield 12 mm |
| Probe 1 | 22.50 | 47.9 mm | 3.17 mm |
| Expose | 56.25 | 118.8 | N.A. |
| Probe 2 | 78.75 | 166.8 | 3.17 mm |
| Probe 3 | 168.75 | 356.0 | 3.17 mm |
| Probe 4 | 236.25 | 489.0 | 3.17 mm |
| Erase | 258.75 | 548.0 | 125 mm |
| Probe 5 | 303.75 | 642.9 | 3.17 mm |

Each photoreceptor was rested in the dark for 15 minutes prior to charging. Each was then negatively corona charged in the dark to a development potential of −900 volts (except for the 10 percent diamine loaded photoreceptor which was charged to a higher potential). Each photoreceptor was thereafter imagewise exposed to a test pattern using a light intensity of about 3.8 erg/cm$^2$ of light. The resulting negatively charged electrostatic latent images were discharged (erased) by exposure to about 200 erg/cm$^2$ of light. The photoinduced discharge characteristics (PIDC) for each photoreceptor was plotted (see FIGS. 3 through 7). The measurements made for the FIGS. are tabulated in the Tables below:

TABLE 2

| 10% DIAMINE (See FIG. 3) | | | |
|---|---|---|---|
| CURVE | STARTING CYCLE | WAVE-LENGTH (nanometers) | MICRO-AMPERES |
| A | 134 | 400–750 | −3.14 |
| B | 173 | Do | −4.44 |
| C | 212 | Do | −5.69 |
| D | 251 | Do | −6.96 |
| E | 290 | Do | −8.13 |
| F | 329 | Do | −9.41 |
| G | 368 | Do | −10.68 |
| H | 407 | Do | −11.97 |
| I | 446 | Do | −13.20 |
| J | 485 | Do | −14.50 |
| K | 524 | Do | −15.79 |
| L | 563 | Do2 | −16.44 |

TABLE 3

| 20% DIAMINE (See FIG. 4) | | | |
|---|---|---|---|
| CURVE | STARTING CYCLE | WAVE-LENGTH (nanometers) | MICRO-AMPERES |
| A | 134 | 400–750 | −3.13 |
| B | 173 | Do | −4.42 |
| C | 212 | Do | −5.64 |
| D | 251 | Do | −6.90 |
| E | 290 | Do | −8.03 |
| F | 329 | Do | −9.29 |
| G | 368 | Do | −10.52 |
| H | 407 | Do | −11.79 |
| I | 446 | Do | −13.07 |
| J | 485 | Do | −14.35 |
| K | 524 | Do | −15.61 |
| L | 563 | Do2 | −16.77 |

TABLE 4

| 30% DIAMINE (See FIG. 5) | | | |
|---|---|---|---|
| CURVE | STARTING CYCLE | WAVE-LENGTH (nanometers) | MICRO-AMPERES |
| A | 134 | 400–750 | −3.11 |
| B | 173 | Do | −4.39 |
| C | 212 | Do | −5.61 |
| D | 251 | Do | −6.86 |
| E | 290 | Do | −7.99 |
| F | 329 | Do | −9.24 |
| G | 368 | Do | −10.47 |
| H | 407 | Do | −11.73 |
| I | 446 | Do | −13.02 |
| J | 485 | Do | −14.31 |
| K | 524 | Do | −15.54 |
| L | 563 | Do | −16.1 |

TABLE 5

| 40% DIAMINE (See FIG. 6) | | | |
|---|---|---|---|
| CURVE | STARTING CYCLE | WAVE-LENGTH (nanometers) | MICRO-AMPERES |
| A | 134 | 400–750 | −3.14 |
| B | 173 | Do | −4.44 |
| C | 212 | Do | −5.67 |
| D | 251 | Do | −6.92 |
| E | 290 | Do | −8.05 |
| F | 329 | Do | −9.31 |
| G | 368 | Do | −10.55 |
| H | 407 | Do | −11.82 |
| I | 446 | Do | −13.10 |
| J | 485 | Do | −14.38 |
| K | 524 | Do | −15.66 |
| L | 563 | Do | −16.83 |

TABLE 6

| 50% DIAMINE (See FIG. 7) | | | |
|---|---|---|---|
| CURVE | STARTING CYCLE | WAVE-LENGTH (nanometers) | MICRO-AMPERES |
| A | 134 | 400–750 | −3.14 |
| B | 173 | Do | −4.43 |
| C | 212 | Do | −5.66 |
| D | 251 | Do | −6.92 |
| E | 290 | Do | −8.06 |
| F | 329 | Do | −9.31 |
| G | 368 | Do | −10.55 |
| H | 407 | Do | −11.81 |
| I | 446 | Do | −13.09 |
| J | 485 | Do | −14.38 |
| K | 524 | Do | −15.64 |
| L | 563 | Do | −16.27 |

The measurement for the 5 percent sample was suspended due to experimental difficulties. PIDC measurements showed that the 30 percent by weight loading of N,N'-diphenyl-N,N'-bis(3-methylphenyl)-[1,1'-biphenyl]-4,4'-diamine had a detectable increase in the background potential from the control, while the values of the background potential measured for the photoreceptors having 40 and 50 percent by weight loadings were the same. The results obtained in Examples III and IV indicate that a 30 percent by weight loading of N,N'-diphenyl-N,N'-bis(3-methylphenyl)-[1,1'-bipheny]-4,4'-diamine exhibited a detectable increase in the residual potential from the control which rendered it inadequate for high quality xerographic applications, but a 35 percent by weight loading of N,N'-diphenyl-N,N'-bis(3-methylphenyl)-[1,1'-biphenyl]-4,4'-diamine could be considered as marginally adequate for high quality xerographic applications requiring residual potentials of less than about 10–15 volts.

EXAMPLE V

Sample transport layers were prepared by cast coating on a Teflon surface and the resulting films were tested for enhancement of mechanical properties by an Instron Mechanical Testing Device to measure tensile modulus and break elongation of the transport layers and a Differential Scanning Calorimeter was used to determine $T_g$ of the transport layers. The relationship of the mechanical properties for different percent by weight loadings of N,N'-diphenyl-N,N'-bis(3-methylphenyl)-[1,1'-biphenyl]-4,4'-diamine is presented in Table 1 below:

TABLE 7

| Mechanical Properties of Diamine Loading in Transport Layer | | | |
|---|---|---|---|
| Polycarbonate/ Diamine | Modulus (psi) | Tg (°C.) | Break Elongation (%) |
| 100/0 | $1.8 \times 10^5$ | 158 | 146 |
| 90/10 | $2.4 \times 10^5$ | 137 | 65 |
| 80/20 | $2.5 \times 10^5$ | 118 | 16 |
| 70/30 | $2.8 \times 10^5$ | 104 | 11 |
| 60/40 | $2.9 \times 10^5$ | 90 | 7 |
| 50/50 | $3.0 \times 10^5$ | 81 | 4.5 |

As shown in Table 1, the break elongation of a charge transport layer was increased from 4.5 percent to 7 percent as the N,N'-diphenyl-N,N'-bis(3-methylphenyl)-[1,1'-biphenyl]-4,4'-diamine loading was reduced from 50 to 40 percent. This represents a 1.6X improvement.

EXAMPLE VI

Photoreceptors were prepared as described in Example I except that the six different charge transport layers were formed on the charge generator layers of six different lots of applying six different mixtures of a solution of a polycarbonate resin having a molecular weight from about 50,000 to about 100,000 (Makrolon, available from Farbenfabriken Bayer A. G.), and N,N'-diphenyl-N,N'-bis(3-methylphenyl)-[1,1'-biphenyl]-4,4'-diamine dissolved in methylene chloride to ultimately provide 50, 40, 30, 20, 10, and 0 percent by weight loadings of N,N'-diphenyl-N,N'-bis(3-methylphenyl)-[1,1'-biphenyl]-4,4'-diamine, respectively, in the dried transport layers of the six lots. These photoreceptors were tested for charge transport layer cracking elongation by stretching each photoreceptor sample using an Instron Mechanical Testing Device. The break elongation of the transport layer was increased from 4.5 percent to 7 percent as the loading of N,N'-diphenyl-N,N'-bis(3-methylphenyl)-[1,1'-biphenyl]-4,4'-diamine in the transport layer was reduced from 50 percent to 40 percent. This represents a 1.6X improvement. Moreover, cycling of a photoreceptor belt containing 40 percent by weight N,N'-diphenyl-N,N'-bis(3-methylphenyl)-[1,1'-biphenyl]-4,4'-diamine over rollers having diameters of 0.75 inch and 1.0 inch during xerographic belt cycling exhibited cracking enhancement by approximately 2 times over the observed for a photoreceptor belt containing 50 percent by weight N,N'-diphenyl-N,N'-bis(3-methylphenyl)-[1,1'-biphenyl]-4,4'-diamine.

EXAMPLE VII

Photoreceptors were prepared as described in Example I except that the charge transport layers were extrusion coated and the two different adhesive layers were formed on the aminosiloxane layers of two different lots. One of the dried adhesive layers contained 49000 polyester resin having a thickness of 500 angstroms and the other dried adhesive layers contained Vitel PE-100 polyester resin (available from Goodyear Tire and Rubber Co.) having a thickness of 500 angstroms. Each of the charge transport layers contained about 50 percent by weight N,N''-diphenyl-N,N''-bis(3-methylphenyl)-[1,1'-biphenyl]-4,4'-diamine. These photoreceptor belts were tested for resistance to seam delamination by cycling over rollers having a diameter of 19 mm in a xerographic imaging device utilizing corona charging, light exposure, magnetic brush development, electrostatic transfer and blade cleaning. The seams of the photoreceptor having the duPont 49000 adhesive layer separated after 3,000 imaging cycles whereas the photoreceptor having the PE-100 adhesive layer had an intact seam at 50,000 cycles.

EXAMPLE VIII

Figure 8:
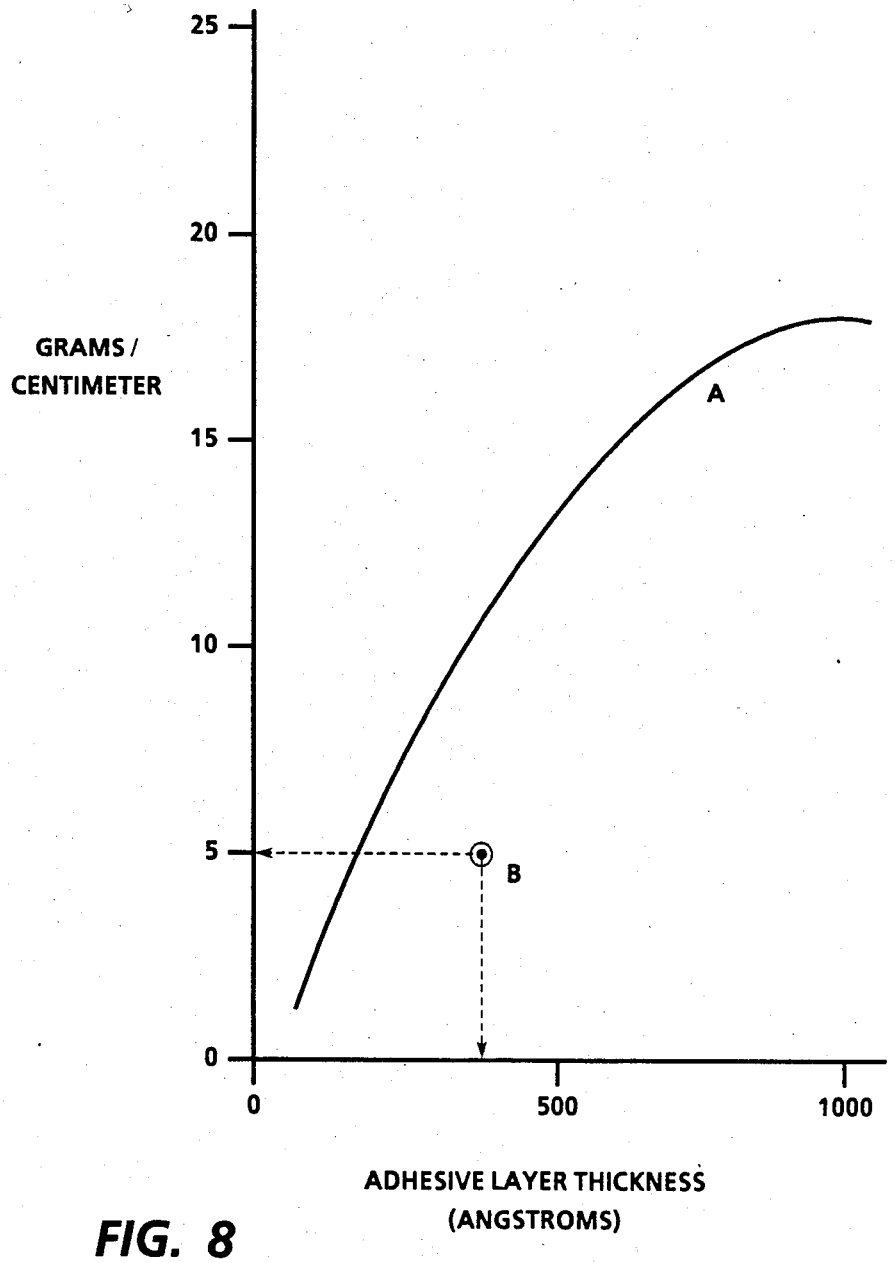
FIG. 8 is a graph of peel force plotted against thickness of the adhesive layer of photoreceptors.

Eight polyester films were each vacuum coated with a titanium layer having a thickness of about 200 Angstroms. The exposed surface of the titanium layer on each polyester film was oxidized by exposure to oxygen in the ambient atmosphere. A siloxane hole blocking layer was prepared by applying a 0.22 percent (0.001 mole) solution of 3-aminopropyl triethoxylsilane to the oxidized surface of the aluminum layer on each polyester film with a gravure applicator. The deposited coatings were dried at 135° C. in a forced air oven to form a layer on each polyester film having a thickness of 450 Angstroms. A coating of polyester resin, (Vitel PE-100, available from the Goodyear Tire and Rubber Co.) was applied with a gravure applicator to the siloxane coated base on each polyester film. The thickness of the coating of polyester film after drying was different for each of the eight polyester films and ranged from about 200 angstroms to about 900 angstroms. A slurry coating solution of 3 percent by weight sodium doped trigonal selenium having a particle size of about 0.05 micrometer to 0.2 micrometer and about 6.8 percent by weight polyvinylcarbazole and 2.4 percent by weight N,N'-diphenyl-N,N'-bis(3 methyl phenyl)-[1,1'-biphenyl]-4,4' diamine in a 1:1 by volume mixture of tetrahydrofuran and toluene was extrusion coated onto each polyester coating to form a layer having a wet thickness of 26 micrometers. The coated member were dried at 135° C. in a forced air oven to form a layer having a thickness of 2.3 micrometers. These coated webs were each coated with a transport layer containing N,N'-diphenyl-N,N'-bis(3-methylphenyl)-[1,1'-biphenyl]-4,4'-diamine in a polycarbonate resin having a molecular weight from about 50,000 to about 100,000 available from Farbenfabriken Bayer A. G. The change transport layer on each web was formed on the charge generator layer by applying a solution of Makrolon, a polycarbonate resin having a molecular weight from about 50,000 to about 100,000 available from Farbenfabriken Bayer A. G., and N,N'-diphenyl-N,N'-bis(3-methylphenyl)-[1,1'-biphenyl]-4,4'-diamine dissolved in methylene chloride to ultimately provide a 50 percent by weight loading of N,N'-diphenyl-N,N'-bis(3-methylphenyl)-[1,1'-biphenyl]-4,4'-diamine in the dried transport layer. The transport layers were extrusion coated on top of the generator layers and dried at temperature of about 135° C. to form a 24 micrometer thick dry layer of hole transporting material on each web. A grounding strip coating and an anti curl backing coating were also applied. The photoreceptors were then cut and welded to form continuous belts. This process was repeated for another polyester film except that a coating of polyester resin, (49000, available from the E. I. du Pont de Nemours & Co.) having a dry thickness of about 400 angstroms was substituted for the Vitel PE-100 coatings to provide a control sample. These photoreceptors were tested for peel strength by 180° peel measurement using an Instron Mechanical Testing Device. The results of the peel strength test is shown in FIG. 8. Curve A represents photoreceptors containing Vitel PE-100 polyester in the adhesive layer and point B represents the photoreceptor containing 49000 polyester in the adhesive layer. The results shown in FIG. 8 clearly demonstrate that the PE-100 layer produced a peel strength approximately 1.9 times greater than that of the 49000 control. The peel strength increased with an increase of Vitel PE-100 thickness and reached a constant value of 18 gm/cm at a thickness of 725 angstroms. Although it is possible that the observed peel strength dependency on the polyester adhesive layer thickness may partly be due to the effect of energy dissipation within the polyester adhesive during peel detachment, nevertheless this contribution to the observed peel strength is expected to be very small and negligible for adhesive layer thinner than 30 micrometers. In addition, no seam delamination was observed for a belt prepared as described in this Example with Vitel PE-100 adhesive layer thickness of about 500 angstroms after 65 hours of cycling over rollers (180° wrap-around) having a diameter of 19 mm in a xerographic imaging device utilizing corona charging, light exposure, magnetic brush development, electrostatic transfer and blade cleaning

EXAMPLE IX

A photoreceptor was prepared as described in Example VIII with a polyester resin (Vitel PE-100) adhesive layer thickness of about 400 angstroms was tested in a xerographic scanner device described in Example IV which drove the photoreceptor sample (tape to an aluminum cylinder having a diameter of 9.5 inches) at a constant speed of 30 inches per second. The photoreceptor was rested in the dark for 15 minutes prior to charging. It was then negatively corona charged in the dark to a development potential of −900 volts. The photoreceptor was thereafter imagewise exposed to a test pattern using a light intensity of about 3.8 erg/cm$^2$ of light. The resulting negatively charged electrostatic latent images were discharged (erased) by exposure to about 200 erg/cm$^2$ of light. The electrical properties of this photoreceptor was substantially equivalent to those obtained for a control identical to the control described in Example VIII. No substantial residual, background, and dark decay impacts were seen when analyzed during xerographic cycling at a speed of 30 inches/sec.

EXAMPLE X

Two photoreceptors were prepared as described in Example VIII, one with a polyester adhesive (Vitel PE-100) layer having a thickness of about 421 angstroms and the other with a duPont 49000 polyester adhesive layer having a thickness of about 400 angstroms, all other layers being the same. Each was sliced longitudinally along each side, cut into segments and formed into a welded belt. Each welded belt was cycled in a belt drive module taken from a Xerox 1075 machine. The belt with the 49000 polyester adhesive layer delaminated in about 500 cycles whereas the belt with the Vitel PE-100 polyester adhesive layer showed no signs of delamination after over 470,000 cycles.

EXAMPLE XI

Six photoreceptors were prepared as described in Example Example I except that the transport layers were extrusion coated, three photoreceptors contained 50 percent by weight of N,N'-diphenyl-N,N'-bis(3-methylphenyl)-[1,1'-biphenyl]-4,4'-diamine in the transport layer and 49000 polyester resin in the adhesive layer and three photoreceptors contained 40 percent by weight of N,N'-diphenyl-N,N'-bis(3-methylphenyl)-[1,1'-biphenyl]-4,4'-diamine in the transport layer and Vitel PE-100 polyester resin in the adhesive layer. One of each type of photoreceptor was cycled in three different xerographic machines having xerographic charge, exposure, development, transfer and cleaning devices to identify resistance to seam delamination. The machines differed from each other in that machine "A" had a 19 mm diameter photoreceptor support roller (stripper roll), a 9.5 mm radius of curvature skid plate, and a 180° belt wrap-around on both the support roller and skid plate; machine "B" had a three roll belt support system including a 19 mm diameter photoreceptor support roller (stripper roll) with a 90° belt wrap-around; and machine "C" had two 19 mm diameter photoreceptor support rollers and a 180° belt wrap-around on both support rollers. The results of the cycling is shown in Table 8 below:

TABLE 8

| | Belt Seam Delamination | |
|---|---|---|
| Machine | 50% Diamine/ 49000 | 40% Diamine/ PE-100 |
| A | ~3,000 cycles | >50,000 cycles |
| B | ~40,000 cycles | >150,000 cycles |
| C | ~15,000 cycles | >130,000 cycles |

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A flexible electrophotographic imaging member comprising in sequence a flexible substrate having an electrically conductive surface, a hole blocking layer comprising an aminosilane reaction product, an adhesive layer having a thickness between about 200 angstroms and about 900 angstroms consisting essentially of at least one copolyester resin reaction product of at least one diacid and at least one diol, a charge generation layer comprising a film forming polymeric component, and a hole transport layer, said hole transport layer being substantially non-absorbing in the special region at which said charge generation layer generates and injects photogenerated holes but being capable of supporting the injection of photogenerated holes from said charge generation layer and transporting the holes through said charge transport layer, said copolyester resin having the following formula:

$$HOC(=O)-[\text{diacid-diol}]_n-OH$$

wherein said diacid is selected from the group consisting of terephthalic acid, isophthalic acid, and mixtures thereof, said diol comprises ethylene glycol, the mole ratio of said diacid to said diol is about 1:1, n is a number between about 175 and about 350 and the $T_g$ of said copolyester resin is between about 50° C. about 80° C.

2. An electrophotographic imaging member according to claim 1 wherein the combination of said flexible substrate having an electrically conductive surface and said blocking layer transmits at least 15 percent of light having a wavelength between about 400 Angstroms and about 700 Angstroms.

3. An electrophotographic imaging member according to claim 1 wherein said electrically conductive surface comprises a thin metal layer.

4. An electrophotographic imaging member according to claim 1 wherein said block layer comprises a siloxane, said siloxane comprising a reaction product of a hydrolyzed silane having the structural formula

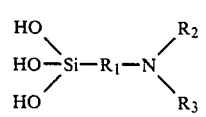

wherein $R_1$ is an alkylidene group containing 1 to 20 carbon atoms and $R_2$ and $R_3$ are independently selected from the group consisting of H, a lower alkyl group containing 1 to 3 carbon atoms, a phenyl group, a poly(ethylene)amino group and an ethylene diamine group.

5. An electrophotographic imaging member according to claim 4 wherein said blocking layer comprising said siloxane has a thickness of between about 20 angstroms and about 2,000 angstroms.

6. An electrophotographic imaging member according to claim 1 wherein said charge generating layer comprises particles or layers comprising a photoconductive material selected from the group consisting of vanadyl phthalocyanine, metal free phthalocyanine, benzimidazole perylene, amorphous selenium, trigonal selenium, selenium alloys selected from the group consisting of selenium-tellurium, selenium-tellurium-arsenic, selenium arsenide, and mixtures thereof.

7. An electrophotographic imaging member according to claim 1 wherein said hole transport layer comprises an organic polymer and an aromatic amine compound having the general formula:

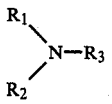

wherein $R_1$ and $R_2$ are an aromatic group selected from the group consisting of a substituted or unsubstituted phenyl group, naphthyl group, and polyphenyl groups and $R_3$ is selected from the group consisting of a substituted or unsubstituted aryl group, alkyl group having from 1 to 18 carbon atoms and cycloaliphatic compounds having from 3 to 18 carbon atoms.

8. An electrophotographic imaging member according to claim 7 wherein said hole transport layer comprises a polycarbonate resin material having a molecular weight of from about 20,000 to about 120,000 and from about 35 to about 45 percent by weight of said diamine compound based on the total weight of said polycarbonate resin.

9. A flexible electrophotographic imaging member having an imaging surface adapted to accept a negative electrical charge, comprising a substrate in sequence, a thin metal layer contiguous to said substrate, a hole blocking layer comprising an aminosiloxane, said aminosiloxane comprising a reaction product of a hydrolyzed aminosilane having the structural formula

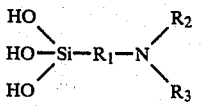

wherein $R_1$ is an alkylidene group containing 1 to 20 carbon atoms and $R_2$ and $R_3$ are independently selected from the group consisting of H, a lower alkyl group containing 1 to 3 carbon atoms, a phenyl group, a poly(ethylene)amino group and an ethylene diamine group, an adhesive layer comprising at least about 90 percent by weight based on the total weight of said adhesive layer of at least one copolyester resin reaction product of at least one diacid and at least one diol, said copolyester resin having the formula:

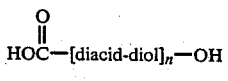

wherein said diacid is selected from the group consisting of terephthalic acid, isophthalic acid, and mixtures thereof, said diol comprises ethylene glycol, the mole ratio of diacid to diol is 1:1, and n is a number between about 175 and about 350, said copolyester resin having a $T_g$ of between about 50° C. about 80° C., a charge generation layer comprising photoconductive particles dispersed in a film forming resin binder, and a hole transfer layer comprising a resin binder and a diamine compound.

10. An electrophotographic imaging member according to claim 9 wherein said charge generation layer comprises particles of trigonal selenium.

11. An electrophotographic imaging member according to claim 9 wherein said charge generating layer comprises particles of vanadium phthalocyanine.

12. An electrophotographic imaging member according to claim 9 wherein said charge generating layer comprises particles of benzimidazole perylene.

13. An electrophotographic imaging member according to claim 9 wherein said charge generation layer is contiguous to a layer comprising a solid solution of a polycarbonate resin material and said diamine compound, said diamine compound being selected from the group consisting of one or more compounds having the general formula:

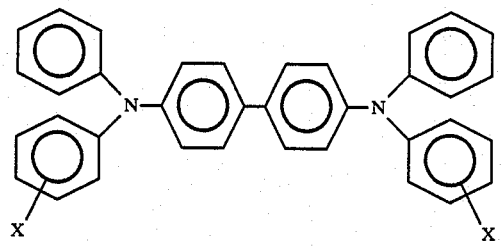

wherein X is selected from the group consisting of an alkyl group having from 1 to about 4 carbon atoms and chlorine.

14. An electrophotographic imaging member comprising in sequence a substrate, a metal layer contiguous to said substrate, a blocking layer comprising an aminosiloxane, said siloxane comprising a reaction product of a hydrolyzed aminosilane having the general formula

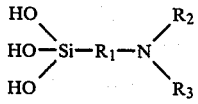

wherein $R_1$ is an alkylidene group containing 1 to 20 carbon atoms and $R_2$ and $R_3$ are independently selected from the group consisting of H, a lower alkyl group containing 1 to 3 carbon atoms, a phenyl group, a poly(ethylene)amino group and an ethylene diamine group, an adhesive layer having a thickness between about 200 angstroms and about 900 angstroms comprising at least about 90 percent by weight based on the total weight of said adhesive layer of at least one copolyester resin reaction product of at least one diacid and at least one diol, said copolyester resin having the formula:

$$HO\overset{O}{\overset{\|}{C}}-[\text{diacid-diol}]_n-OH$$

wherein said diacid is selected from the group consisting of terephthalic acid, isophthalic acid, and mixtures thereof, said diol comprises ethylene glycol, the mole ratio of diacid to diol is 1:1, and n is a number between about 175 and about 350, said copolyester resin having a $T_g$ of between about 50° C. about 80° C., a charge generation layer comprising photoconductive particles dispersed in a film forming binder, and a hole transport layer comprising a solid solution of a polycarbonate resin material and a diamine compound, said diamine compound having the general formula:

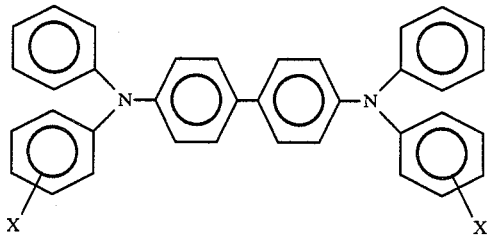

wherein X is selected from the group consisting of an alkyl group having from 1 to about 4 carbon atoms and chlorine.

15. An electrophotographic imaging member according to claim 14 wherein said charge generation layer comprises from about 10 percent by volume to about 50 percent by volume of said photoconductive pigment is dispersed in about 50 percent by volume to about 90 percent by volume of said film forming binder.

16. An electrophotographic imaging member according to claim 15 wherein said adhesive layer has a thickness between about 400 angstroms and about 700 angstroms.

17. An electrophotographic imaging member according to claim 15 wherein said charge generation layer has a thickness between about 0.1 micrometer and about 5 micrometers.

18. An electrophotographic imaging member according to claim 15 wherein said hole transport layer has a thickness between about 5 micrometers and about 100 micrometers.

19. An electrophotographic imaging process comprising providing a flexible electrophotographic imaging belt comprising in sequence a substrate, a metal layer contiguous to said substrate, a blocking layer comprising an aminosiloxane, said aminosiloxane comprising a reaction product of a hydrolyzed silane having the general formula

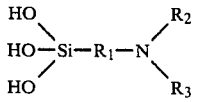

wherein $R_1$ is an alkylidene group containing 1 to 20 carbon atoms and $R_2$ and $R_3$ are independently selected from the group consisting of H, a lower alkyl group containing 1 to 3 carbon atoms, a phenyl group, a poly(ethylene)amino group and an ethylene diamine group, an adhesive layer having a thickness between about 400 angstroms and about 700 angstroms comprising at least about 90 percent by weight based on the total weight of said adhesive layer of at least one copolyester resin reaction product of at least one diacid and at least one diol, said copolyester resin having the formula:

$$HO\overset{O}{\overset{\|}{C}}-[\text{diacid-diol}]_n-OH$$

wherein said diacid is selected from the group consisting of terephthalic acid, isophthalic acid, and mixtures thereof, said diol is selected from the group consisting of ethylene glycol, 2,2-dimethyl propane and mixtures thereof, the ratio of diacid to diol is 1:1, and n is a number between about 175 and about 350, said copolyester resin having a $T_g$ of between about 50° C. about 80° C., a charge generation layer comprising photoconductive particles dispersion in a film forming binder, and a hole transport layer comprising a solid solution of a polycarbonate resin material and a diamine compound, said diamine compound having the general formula:

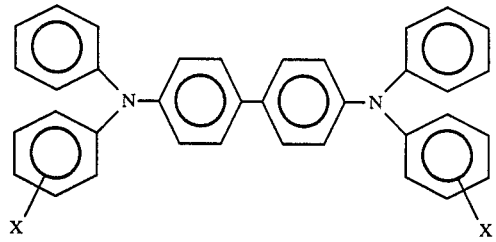

wherein X is selected from the group consisting of an alkyl group having from 1 to about 4 carbon atoms and chlorine, uniformly electrostatically charging said imaging belt, exposing said imaging belt to a pattern of activating electromagnetic radiation to form an electrostatic latent image corresponding to said pattern, depositing electrostatically attractable marking particles on said imaging belt to form a toner image corresponding to said electrostatic latent image, transferring said toner image to a receiving member, transporting said imaging belt around at least one roller having a diameter of between about 0.5 inch and about 1 inch, and repeating said charging, exposing, depositing, transferring and transporting steps a plurality of times.

20. A process for preparing a electrophotographic imaging process comprising providing a flexible electrophotographic imaging member comprising in sequence a flexible substrate having an electrically conductive surface, applying a hole blocking layer comprising an aminosilane reaction product, applying an adhesive layer solution comprising at least one solvent and between about 2 percent and about 5 percent by weight of at least one copolyester resin reaction product of at least one diacid and at least one diol to form a dried layer having a thickness between about 200 angstroms and about 900 angstroms and consisting essentially of said copolyester resin reaction product, applying a charge generation layer comprising a film forming polymeric component, and applying a hole transport layer, said hole transport layer being substantially non-absorbing in the spectral region at which said charge generation layer generates and injects photogenerated holes but being capable of supporting the injection of photogenerated holes from said charge generation layer and transporting the holes through said charge transport layer, said copolyester resin having the following formula:

$$\overset{O}{\overset{\|}{HOC}}-[\text{diacid-diol}]_n-OH$$

wherein said diacid is selected from the group consisting of terephthalic acid, isophthalic acid, and mixtures thereof, said diol comprises ethylene glycol, the mole ratio of said diacid to said diol is about 1:1, n is a number between about 175 and about 350 and the $T_g$ of said copolyester resin is between about 50° C. about 80° C.

* * * * *